US011746783B2

(12) United States Patent
Seol et al.

(10) Patent No.: US 11,746,783 B2
(45) Date of Patent: Sep. 5, 2023

(54) ROTARY COMPRESSOR

(71) Applicant: LG ELECTRONICS INC., Seoul (KR)

(72) Inventors: Seseok Seol, Seoul (KR); Seoungmin Kang, Seoul (KR); Bumdong Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 105 days.

(21) Appl. No.: 17/181,076

(22) Filed: Feb. 22, 2021

(65) Prior Publication Data

US 2022/0003235 A1 Jan. 6, 2022

(30) Foreign Application Priority Data

Jul. 3, 2020 (KR) ..... 10-2020-0082373

(51) Int. Cl.
*F04C 18/344* (2006.01)
*F04C 29/00* (2006.01)

(52) U.S. Cl.
CPC ..... *F04C 18/344* (2013.01); *F04C 29/0028* (2013.01)

(58) Field of Classification Search
CPC ..... F04C 18/344–352; F04C 29/0057; F04C 29/0071; F04C 2/344–352; F01C 21/0836; F01C 1/344–352
See application file for complete search history.

(56) References Cited

U.S. PATENT DOCUMENTS 2,278,131 A * 3/1942 Livermore ..... F04C 2/3441 418/241
2,487,721 A * 11/1949 Minshall ..... F04C 2/344 418/192

(Continued)

FOREIGN PATENT DOCUMENTS

CN 101290008 A * 10/2008 ..... F01C 21/0845
DE 10 2006 012868 9/2007

(Continued)

OTHER PUBLICATIONS

Korean Office Action dated Aug. 20, 2021 issued in Application No. 10-2020-0082373.

(Continued)

*Primary Examiner* — Mark A Laurenzi
*Assistant Examiner* — Xiaoting Hu
(74) *Attorney, Agent, or Firm* — KED & ASSOCIATES

(57) ABSTRACT

A rotary compressor is provided that may include a rotational shaft, first and second bearings configured to support the rotational shaft in a radial direction, a cylinder disposed between the first and second bearings to form a compression space, a rotor disposed in the compression space and coupled to the rotational shaft to compress a refrigerant as the rotor rotates, and at least one vane slidably inserted into the rotor, the at least one vane coming into contact with an inner peripheral surface of the cylinder to separate the compression space into a plurality of regions. The at least one vane may include a pin that extends in an axial direction, and at least one of the first bearing and the second bearing may include a rail groove into which the pin may be inserted.

7 Claims, 12 Drawing Sheets

(56) References Cited

U.S. PATENT DOCUMENTS

| | | | | | |
|---|---|---|---|---|---|
| 2,545,238 | A * | 3/1951 | MacMillin | F01C 21/0863 | 418/268 |
| 2,650,754 | A | 9/1953 | Simon | | |
| 2,839,007 | A * | 6/1958 | Benedek | F01C 1/3446 | 418/236 |
| 2,919,651 | A * | 1/1960 | Gardiner | F01C 21/0863 | 418/79 |
| 3,086,475 | A * | 4/1963 | Rosaen | F01C 21/0863 | 418/268 |
| 3,255,704 | A * | 6/1966 | Mazur | F04C 2/3446 | 418/268 |
| 3,455,247 | A * | 7/1969 | Daniels | F01C 21/0863 | 418/175 |
| 3,711,227 | A * | 1/1973 | Schmitz | F04C 2/3441 | 418/268 |
| 3,791,353 | A * | 2/1974 | Catherwood | F02B 53/12 | 123/228 |
| 4,255,100 | A * | 3/1981 | Linder | F04C 29/126 | 418/184 |
| 4,355,965 | A * | 10/1982 | Lowther | F01C 21/0809 | 418/268 |
| 4,410,305 | A | 10/1983 | Shank et al. | | |
| 4,521,167 | A | 6/1985 | Cavalleri et al. | | |
| 4,551,079 | A * | 11/1985 | Kain | F04C 11/001 | 418/173 |
| 4,746,280 | A * | 5/1988 | Wystemp | F01C 21/0809 | 418/268 |
| 4,799,867 | A | 1/1989 | Sakamaki et al. | | |
| 4,859,163 | A | 8/1989 | Schuller | | |
| 4,886,392 | A | 12/1989 | Iio | | |
| 5,160,252 | A * | 11/1992 | Edwards | F01C 21/0836 | 418/265 |
| 5,302,096 | A | 4/1994 | Cavalleri | | |
| 9,115,716 | B2 | 8/2015 | Sekiya et al. | | |
| 2008/0118384 | A1* | 5/2008 | Nishikata | F04C 2/3442 | 418/111 |
| 2009/0285709 | A1 | 11/2009 | Mooy et al. | | |
| 2012/0009078 | A1* | 1/2012 | Maeyama | F04C 18/352 | 418/63 |
| 2013/0058808 | A1* | 3/2013 | Huser | F01C 21/0809 | 417/410.3 |
| 2013/0149178 | A1* | 6/2013 | Sekiya | F04C 18/352 | 418/55.1 |
| 2014/0140866 | A1 | 5/2014 | Pfister et al. | | |
| 2015/0064042 | A1* | 3/2015 | Shimaguchi | F04C 28/10 | 418/259 |
| 2016/0333877 | A1 | 11/2016 | Tsuda | | |
| 2020/0158111 | A1 | 5/2020 | Park | | |
| 2021/0301818 | A1 | 9/2021 | Moon | | |

FOREIGN PATENT DOCUMENTS

| | | | | |
|---|---|---|---|---|
| DE | 10 2013 223999 | | 5/2015 | |
| EP | 2 219 917 | | 12/2011 | |
| ES | 2284342 | A1 * | 11/2007 | F04C 2/3441 |
| JP | S58-8201 | | 1/1983 | |
| JP | 07259503 | A * | 10/1995 | F01C 1/3442 |
| JP | 2002-039084 | | 2/2002 | |
| JP | 2002039084 | A * | 2/2002 | |
| JP | 2002-155878 | | 5/2002 | |
| JP | 2002155878 | A * | 5/2002 | |
| JP | 2002221164 | A * | 8/2002 | F01C 21/08 |
| JP | 2006-152903 | | 6/2006 | |
| JP | 2015-117608 | | 6/2015 | |
| KR | 20-1999-0014251 | | 4/1999 | |
| KR | 10-2011-0106045 | | 9/2011 | |
| KR | 10-2012-0112790 | | 10/2012 | |
| KR | 10-2018-0094411 | | 8/2018 | |
| KR | 10-2020-0054026 | | 5/2020 | |
| WO | WO 95/35431 | | 12/1995 | |
| WO | WO-2013105463 | A1 * | 7/2013 | F01C 21/0836 |
| WO | WO 2020/042435 | | 3/2020 | |
| WO | WO 2020/173118 | | 9/2020 | |

OTHER PUBLICATIONS

European Search Report dated Oct. 4, 2021 issued in Application No. 21171474.6.
U.S. Office Action dated Jun. 23, 2022 issued in U.S. Appl. No. 17/179,708.
Korean Office Action dated Jun. 15, 2021 (61626).
Korean Office Action dated Jun. 15, 2021 (61630).
European Search Report issued in Application No. 21165131.0 dated Aug. 13, 2021.
U.S. Appl. No. 17/183,505, filed Feb. 24, 2021.
U.S. Appl. No. 17/179,708, filed Feb. 19, 2021.
U.S. Appl. No. 17/177,683, filed Feb. 17, 2021.
Korean Office Action dated Mar. 23, 2021.
European Search Report issued in Application No. 21164461.2 dated Jun. 4, 2021.
U.S. Office Action dated Apr. 8, 2022 issued in U.S. Appl. No. 17/177,683.
U.S. Office Action dated Feb. 1, 2023 issued in U.S. Appl. No. 17/183,505.

* cited by examiner

ROTARY COMPRESSOR

CROSS-REFERENCE TO RELATED APPLICATION(S)

This application claims priority under 35 U.S.C. § 119 to Korean Application No. 10-2020-0082373 filed on Jul. 3, 2020, whose entire disclosure is hereby incorporated by reference.

BACKGROUND

1. Field

A rotary compressor is disclosed herein.

2. Background

In general, a compressor refers to a device configured to receive power from a power generating device, such as a motor or a turbine, and compress a working fluid, such as air or a refrigerant. More specifically, the compressor is widely applied to the entire industry of home appliances, in particular, a vapor compression type refrigeration cycle (hereinafter referred to as a "refrigeration cycle").

Compressors may be classified into a reciprocating compressor, a rotary compressor, or a scroll compressor according to a method of compressing the refrigerant. A compression method of the rotary compressor may be classified into a method in which a vane is slidably inserted into a cylinder to come into contact with a roller, and a method in which a vane is slidably inserted into a roller to come into contact with a cylinder. In general, the former is referred to as a rotary compressor and the latter is referred to as a vane rotary compressor.

In the rotary compressor, the vane inserted into the cylinder is drawn out toward the roller by an elastic force or a back pressure, and comes into contact with an outer peripheral surface of the roller. In the vane rotary compressor, the vane inserted into the roller rotates with the roller and is drawn out by a centrifugal force and a back pressure, and comes into contact with an inner peripheral surface of the cylinder.

In the rotary compressor, compression chambers as many as a number of vanes per rotation of the roller are independently formed, and the respective compression chambers perform suction, compression, and discharge strokes at the same time. In the vane rotary compressor, compression chambers as many as a number of vanes per rotation of the roller are continuously formed, and the respective compression chambers sequentially perform suction, compression, and discharge strokes.

In the vane rotary compressor, in general, a plurality of vanes rotates together with the roller and slide in a state in which a distal end surface of the vane is in contact with the inner peripheral surface of the cylinder, and thus, friction loss increases compared to a general rotary compressor. In addition, in the vane rotary compressor, the inner peripheral surface of the cylinder is formed in a circular shape. However, recently, a vane rotary compressor (hereinafter, referred to as a "hybrid rotary compressor") has been introduced, which has a so-called hybrid cylinder an inner peripheral surface of which is formed in an ellipse or a combination of an ellipse and a circle, and thus, friction loss is reduced and compression efficiency improved.

In the hybrid rotary compressor, the inner peripheral surface of the cylinder is formed in an asymmetrical shape.

Accordingly, a location of a contact point which separates a region where a refrigerant flows in and a compression strokes starts and a region where a discharge stroke of a compressed refrigerant is performed has a great influence on efficiency of the compressor.

In particular, in a structure in which a suction port and a discharge port are sequentially formed adjacent to each other in a direction opposite to a rotational direction of the roller in order to achieve a high compression ratio by increasing a compression path as much as possible, the position of the contact point greatly affects the efficiency of the compressor. However, the compression efficiency decreases due to contact between the vane and the cylinder, and reliability decreases due to wear.

BRIEF DESCRIPTION OF THE DRAWINGS

Embodiments will be described in detail with reference to the following drawings in which like reference numerals refer to like elements, and wherein.

DETAILED DESCRIPTION

Figure 1:
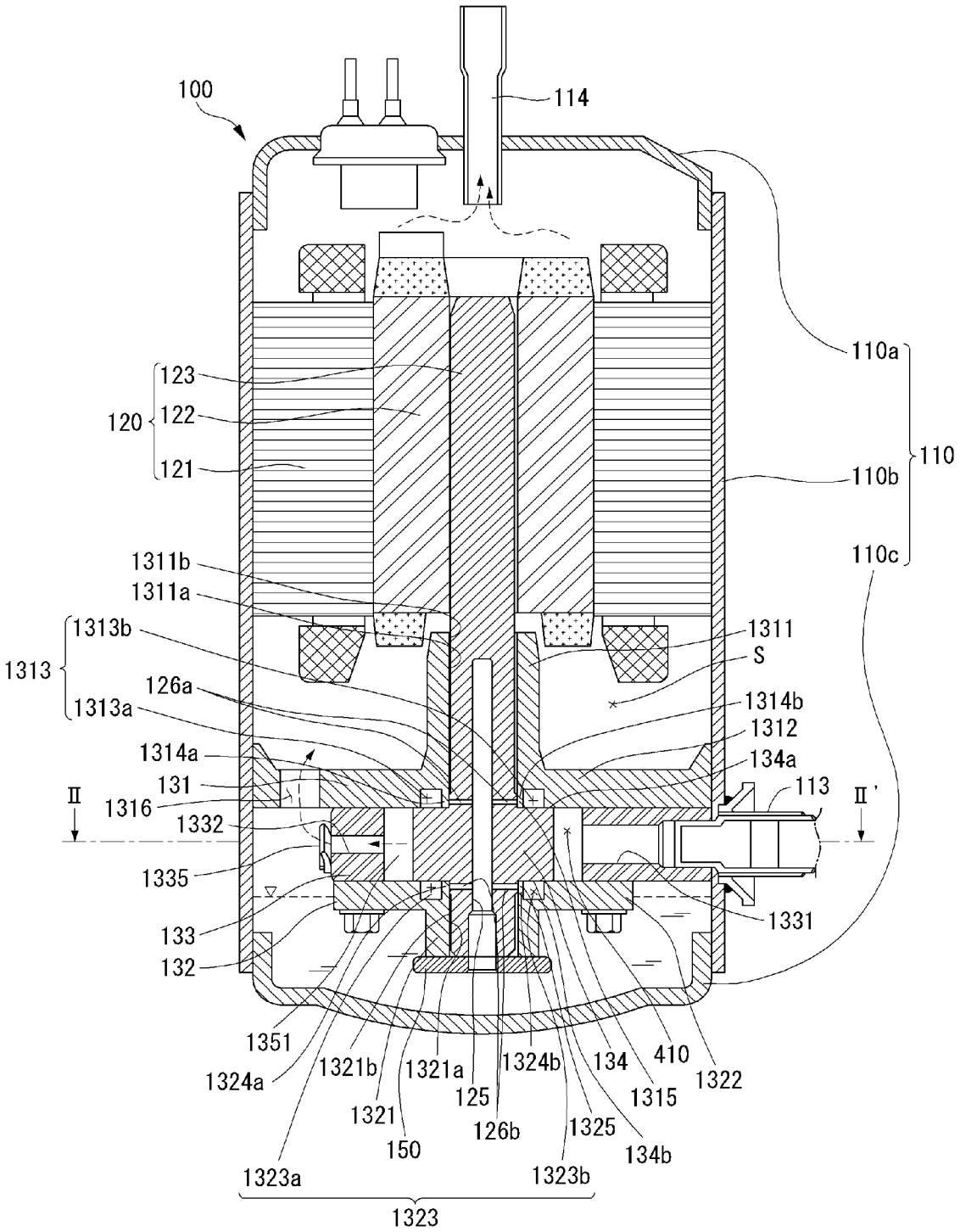
FIG. 1 is a vertical cross-sectional view of a rotary compressor according to an embodiment.

Hereinafter, embodiments will be described with reference to the accompanying drawings. Wherever possible, the same or similar components have been assigned the same or similar reference numerals, and repetitive description has been omitted.

In describing embodiments, when a component is referred to as being "coupled" or "connected" to another component, it should be understood that the component may be directly coupled to or connected to another component, both different components may exist therebetween.

In addition, in describing embodiments, if it is determined that description of related known technologies may obscure the gist of embodiments, the description will be omitted. In addition, the accompanying drawings are for easy understanding of the embodiments, and a technical idea disclosed is not limited by the accompanying drawings, and it is to be understood as including all changes, equivalents, or substitutes falling within the spirit and scope.

Meanwhile, terms of the specification can be replaced with terms such as document, specification, description.

Figure 2:
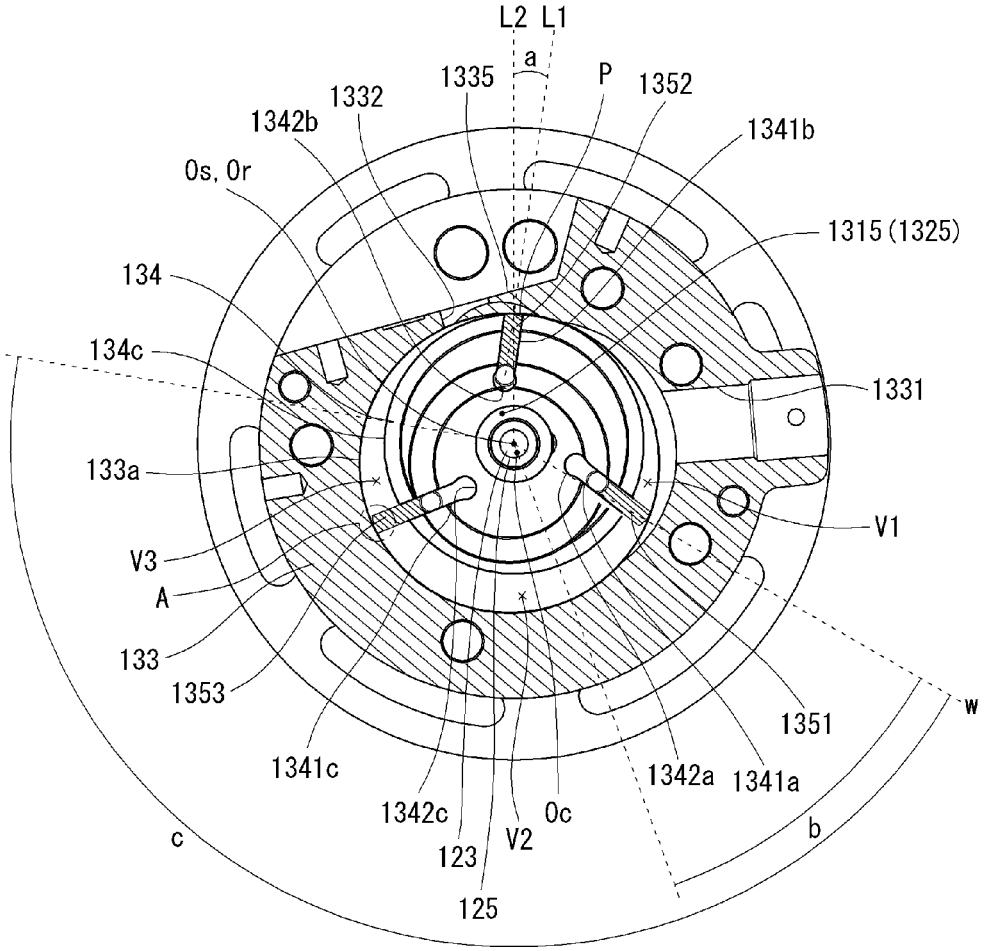
FIG. 2 is a cross-sectional view of FIG. 1, taken along line II-II'.
Figure 3:
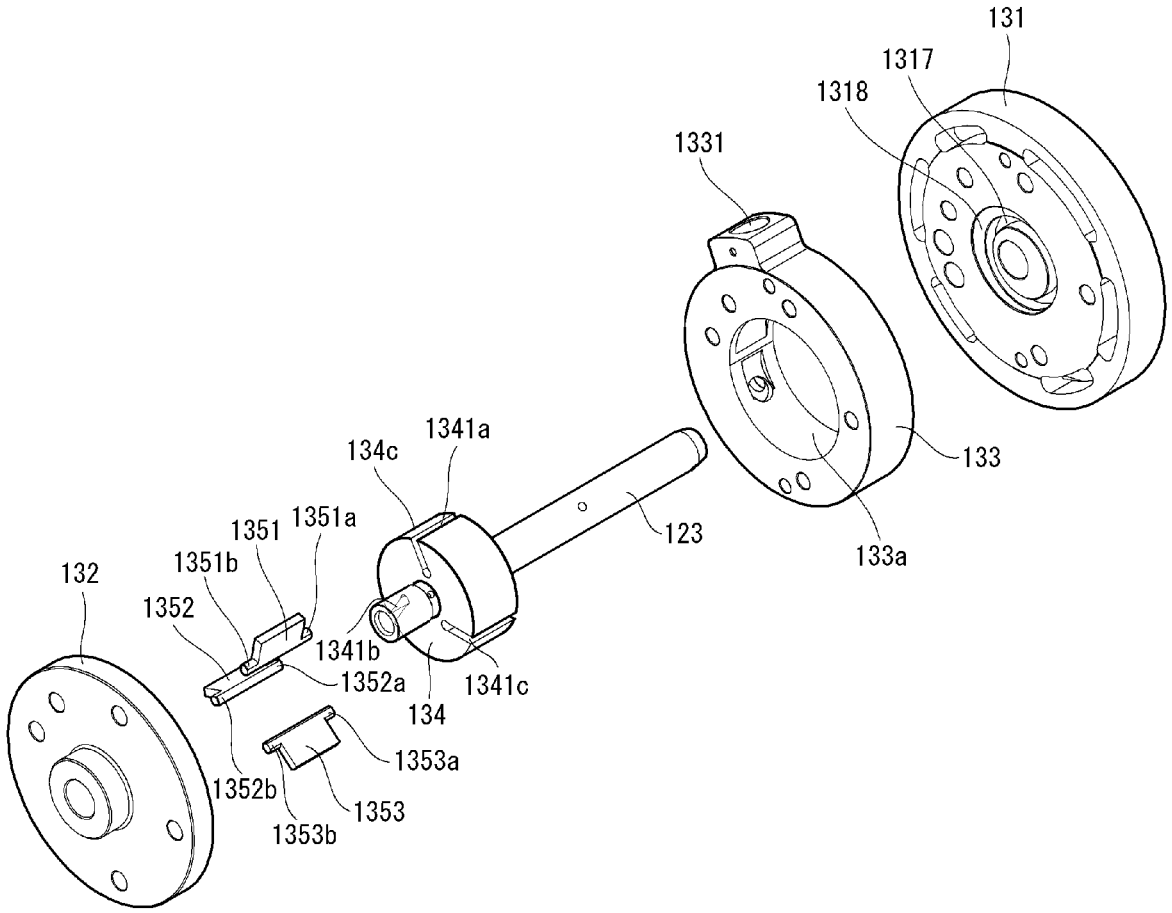
FIGS. 3 and 4 are exploded perspective views of a partial configuration of a rotary compressor according to an embodiment.
Figure 4:
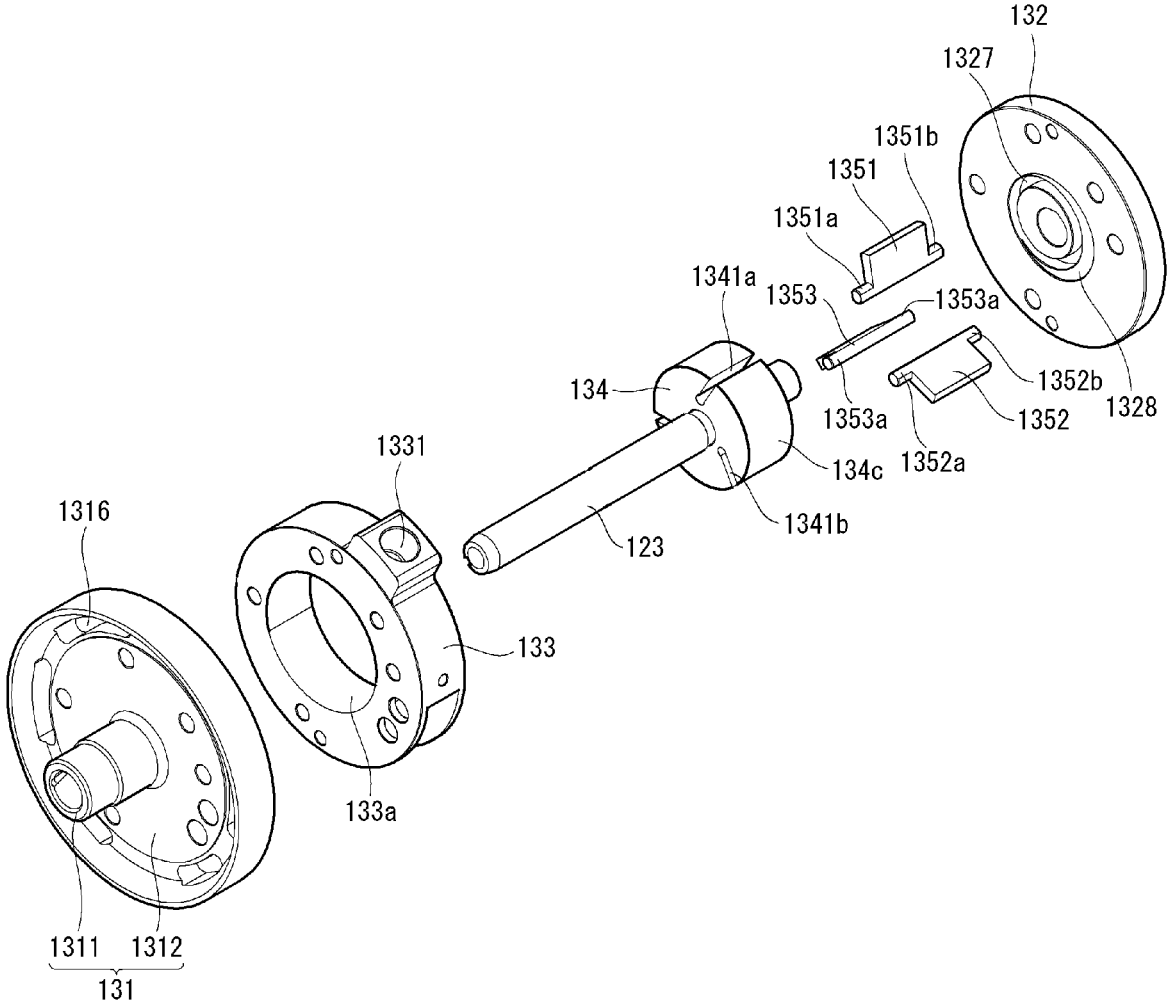
Figure 5:
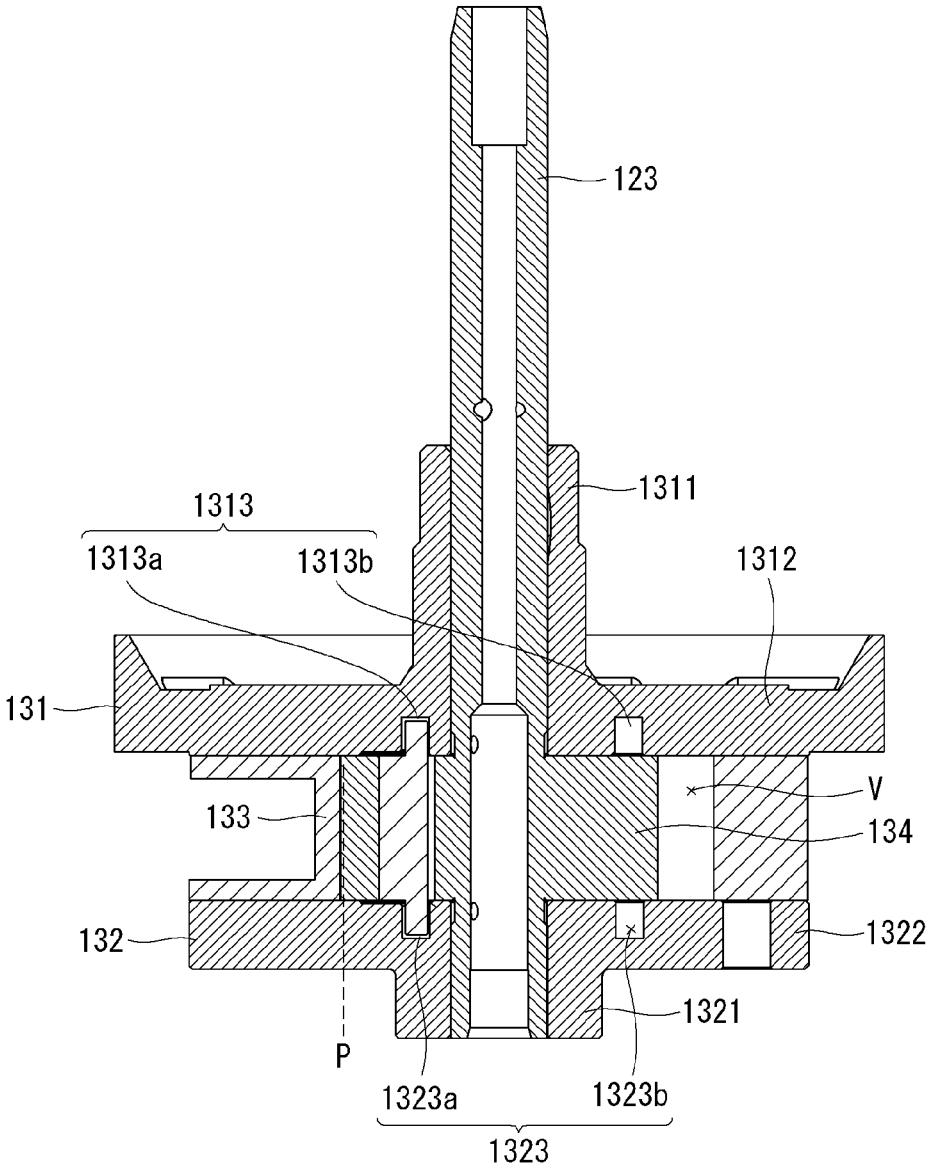
FIG. 5 is a vertical cross-sectional view of a partial configuration of a rotary compressor according to an embodiment.
Figure 6:
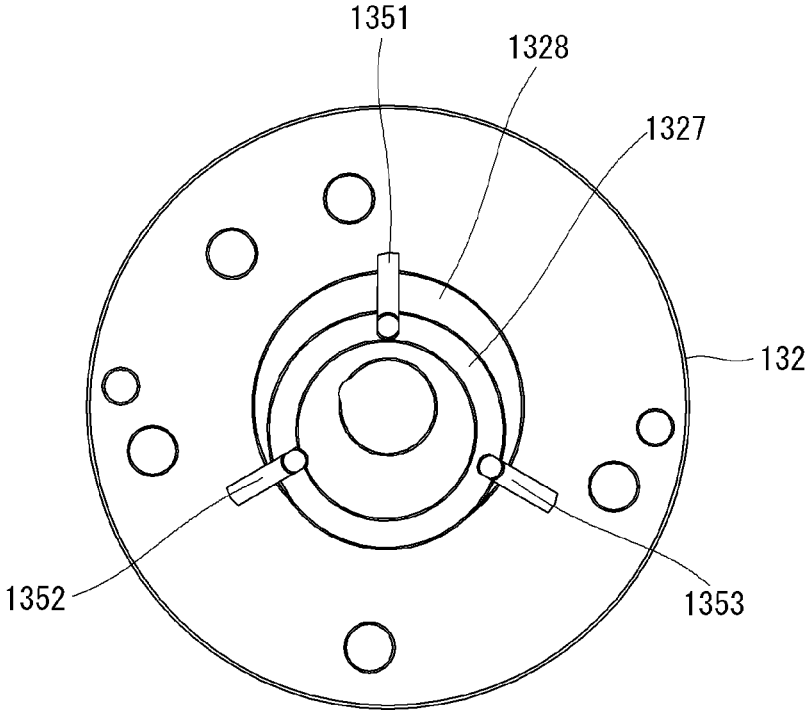
FIG. 6 is a plan view of a partial configuration of a rotary compressor according to an embodiment.
Figure 7:
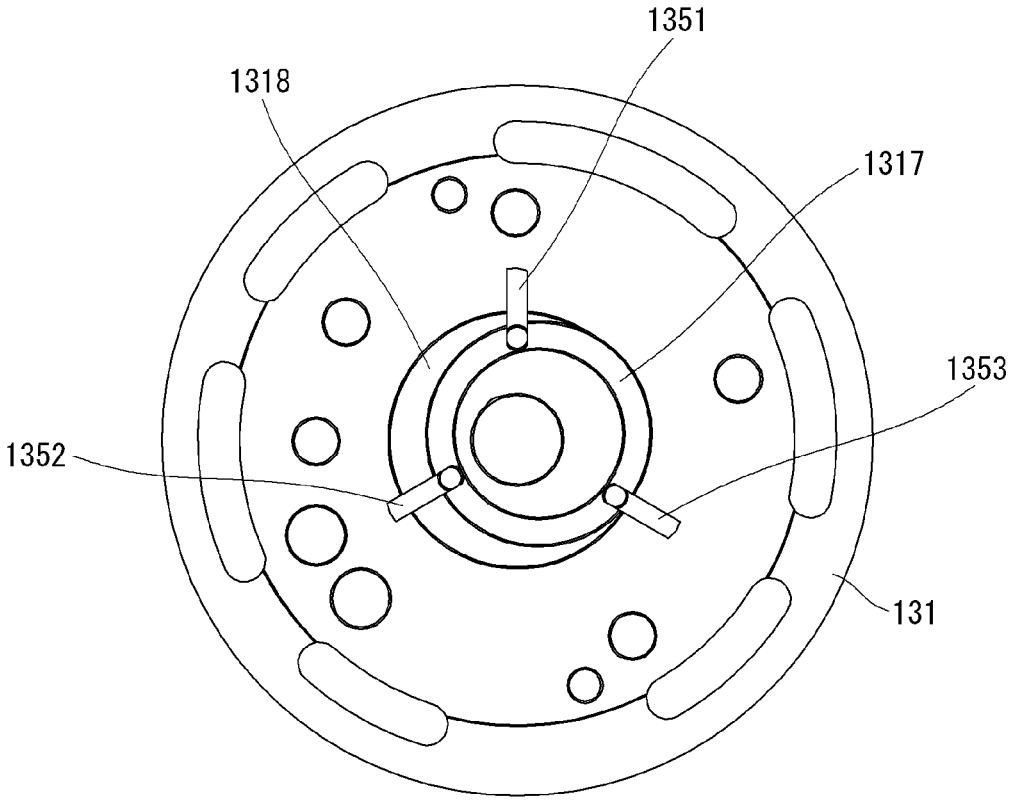
FIG. 7 is a bottom view of a partial configuration of a rotary compressor according to an embodiment.
Figure 8:
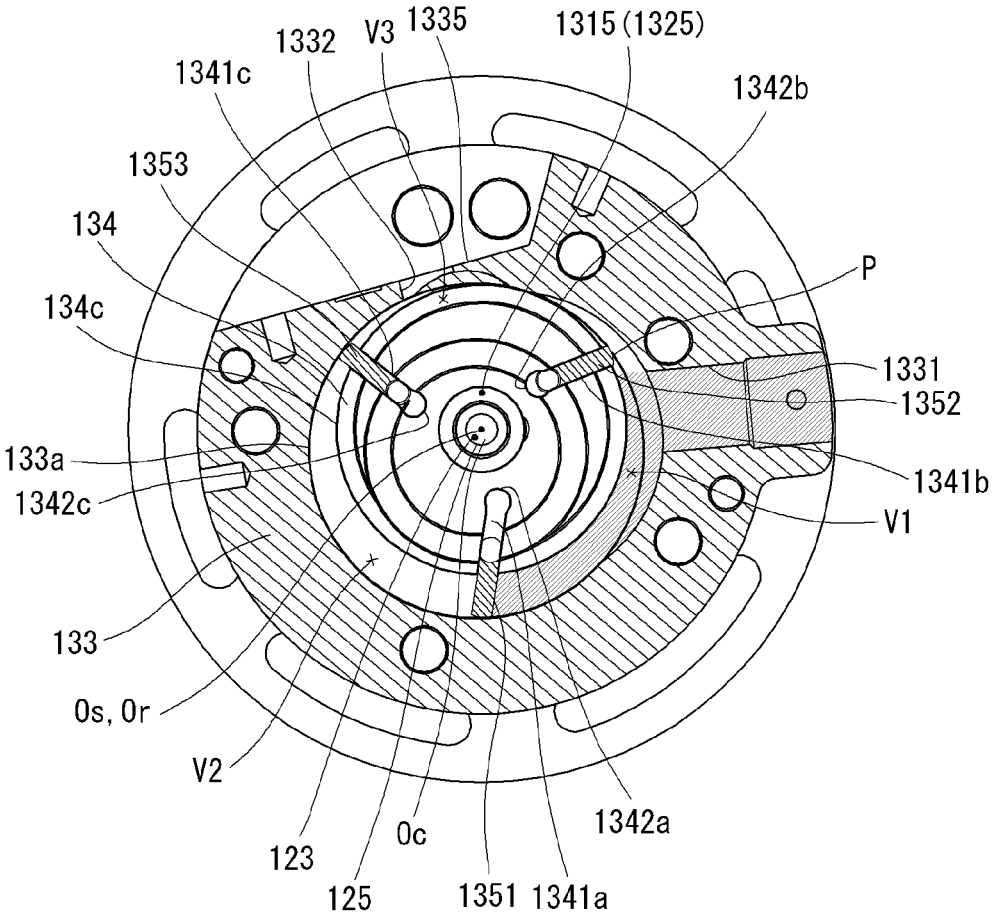
FIGS. 8 to 10 are operational diagrams of a rotary compressor according to an embodiment.
Figure 9:
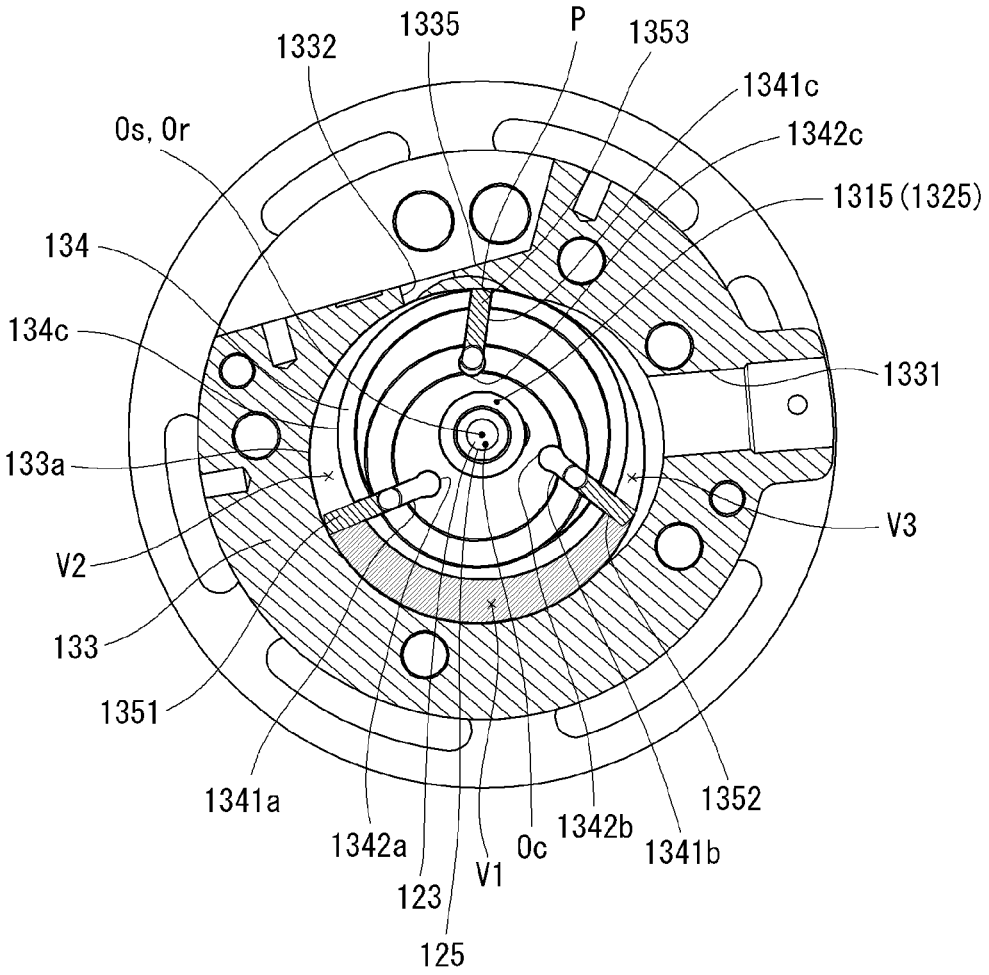
Figure 10:
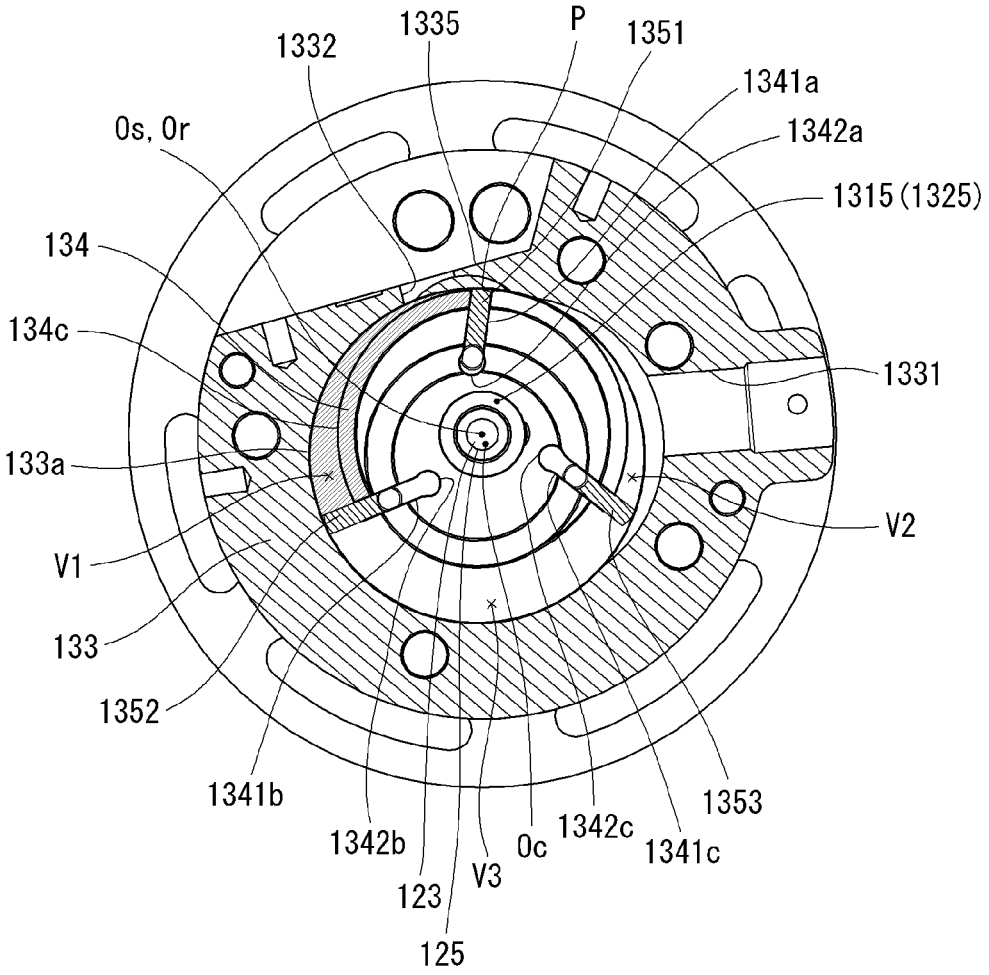
Figure 11:
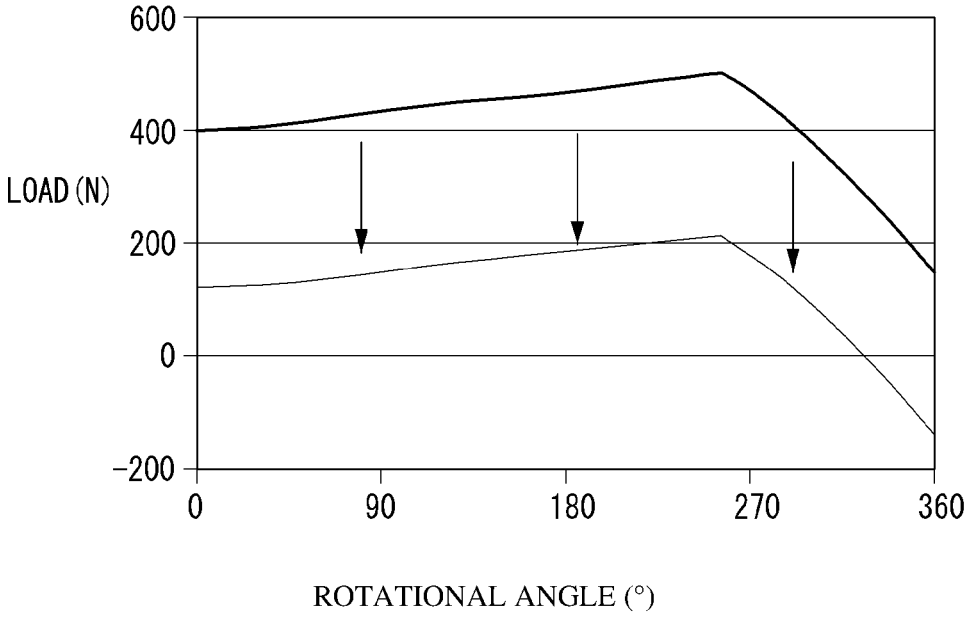
FIG. 11 is a graph illustrating a load applied to a pin as a rotary compressor according to an embodiment rotates.
Figure 12:
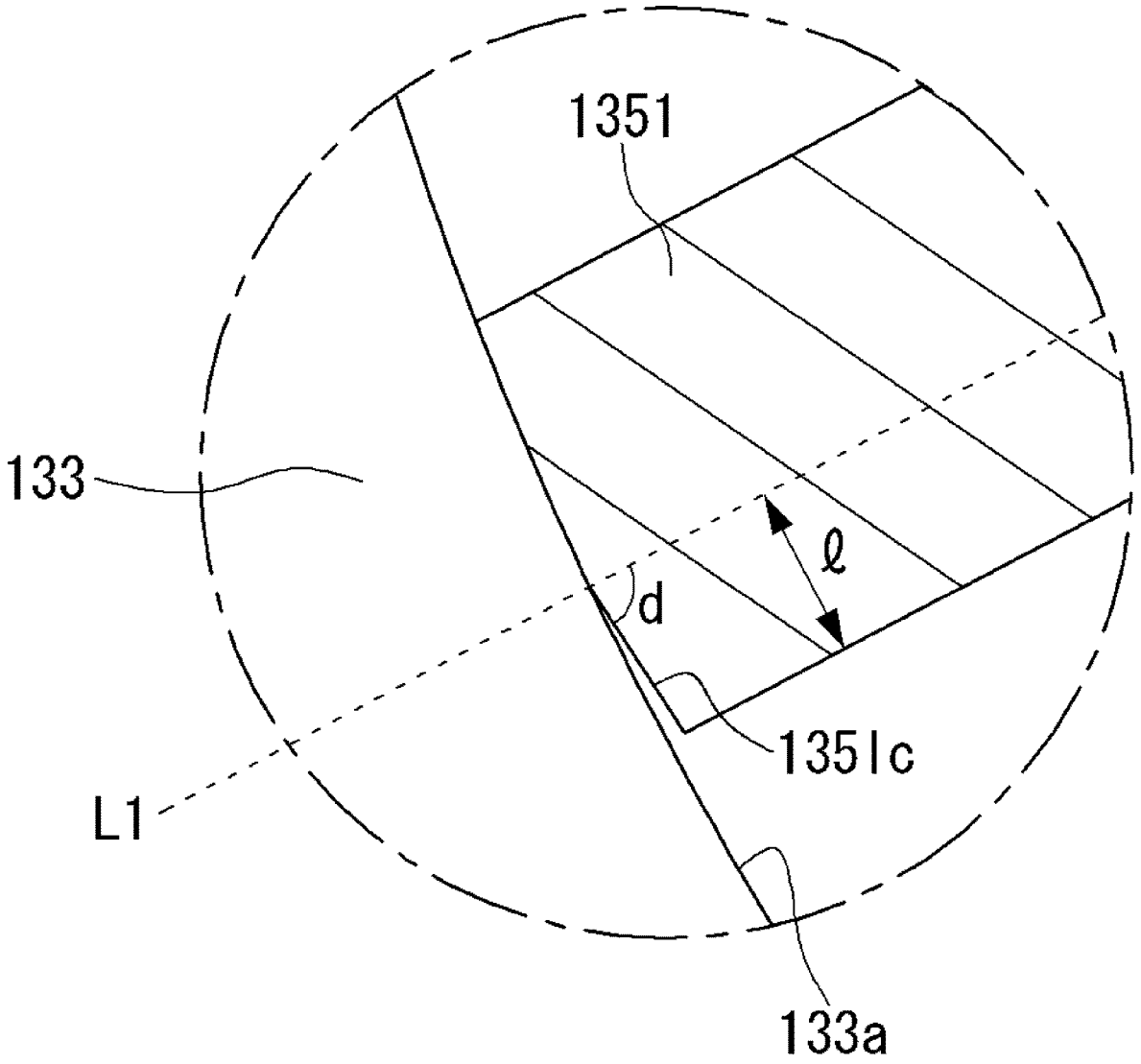
FIG. 12 is an enlarged view of portion A of FIG. 2.

FIG. 1 is a vertical cross-sectional view of a rotary compressor according to an embodiment. FIG. 2 is a cross-sectional view of FIG. 1, taken along line II-II'. FIGS. 3 and 4 are exploded perspective views of a partial configuration of a rotary compressor according to an embodiment. FIG. 5 is a vertical cross-sectional view of a partial configuration of a rotary compressor according to an embodiment. FIG. 6 is a plan view of a partial configuration of a rotary compressor according to an embodiment. FIG. 7 is a bottom view of a partial configuration of a rotary compressor according to an embodiment. FIGS. 8 to 10 are operational diagrams of a rotary compressor according to an embodiment. FIG. 11 is a graph illustrating a load applied to a pin as a rotary compressor according to an embodiment rotates. FIG. 12 is an enlarged view of portion A of FIG. 2.

Referring to FIGS. 1 to 12, a rotary compressor 100 according to an embodiment may include a casing 110, a drive motor 120, and compression units 131, 132, and 133. However, the rotary compressor 100 may further include additional components.

The casing 110 may form an exterior of the rotary compressor 100. The casing 110 may be formed in a cylindrical shape. The casing 110 may be divided into a vertical type casing or a horizontal type casing according to an installation mode of the rotary compressor 100. The vertical type casing may be a structure in which the drive motor 120 and the compression units 131, 132, 133, and 134 are disposed on upper and lower sides along an axial direction, and the horizontal type casing may be a structure in which the drive motor 120 and the compression units 131, 132, 133, and 134 are disposed on left and right or lateral sides. The drive motor 120, a rotational shaft 123, and the compression units 131, 132, 133, and 134 may be disposed inside of the casing 110. The casing 110 may include an upper shell 110*a*, an intermediate shell 110*b*, and a lower shell 110*c*. The upper shell 110*a*, the intermediate shell 110*b*, and the lower shell 110*c* may seal an inner space S.

The drive motor 120 may be disposed in the casing 110. The drive motor 120 may be fixed inside of the casing 110. The compression units 131, 132, 133, and 134 mechanically coupled by the rotational shaft 123 may be installed on or at one side of the drive motor 120.

The drive motor 120 may provide power to compress a refrigerant. The drive motor 120 may include a stator 121, a rotor 122, and the rotational shaft 123.

The stator 121 may be disposed in the casing 110. The stator 121 may be disposed inside of the casing 110. The stator 121 may be fixed inside of the casing 110. The stator 121 may be mounted on an inner peripheral surface of the cylindrical casing 110 by a method, such as shrink fit, for example. For example, the stator 121 may be fixedly installed on an inner peripheral surface of the intermediate shell 110*b*.

The rotor 122 may be spaced apart from the stator 121. The rotor 122 may be disposed inside of the stator 121. The rotational shaft 123 may be disposed on the rotor 122. The rotational shaft 122 may be disposed at a center of the rotor 122. The rotational shaft 123 may be, for example, press-fitted to the center of the rotor 122.

When power is applied to the stator 121, the rotor 122 may be rotated according to an electromagnetic interaction between the stator 121 and the rotor 122. Accordingly, the rotational shaft 123 coupled to the rotor 122 may rotate concentrically with the rotor 122.

An oil flow path 125 may be formed at a center of the rotational shaft 123. The oil flow path 125 may extend in the axial direction. Oil through holes 126*a* and 126*b* may be formed in a middle of the oil flow path 125 toward an outer peripheral surface of the rotational shaft 123.

The oil through holes 126*a* and 126*b* may include first oil through hole 126*a* belonging to a range of a first bearing portion 1311 and second oil through hole 126*b* belonging to a range of a second bearing portion 1321. One first oil through hole 126*a* and one second oil through hole 126*b* may be formed or a plurality of oil through holes 126*a* and a plurality of oil through holes 126*b* may be formed.

An oil feeder 150 may be disposed in or at a middle or a lower end of the oil flow path 125. When the rotational shaft 123 rotates, oil filling a lower portion of the casing 110 may be pumped by the oil feeder 150. Accordingly, the oil may be raised along the oil flow path 125, may be supplied to a sub bearing surface 1321*a* through the second oil through hole 126*b*, and may be supplied to a main bearing surface 1311*a* through the first oil through hole 126*a*.

The first oil through hole 126*a* may be formed to overlap the first oil groove 1311*b*. The second oil through hole 126*b* may be formed to overlap the second oil groove 1321*b*. That is, oil supplied to the main bearing surface 1311*a* of main bearing 131 of compression units 131, 132, 133, and 134 and a sub bearing surface 1321*a* of sub bearing 132 of compression units 131, 132, 133, and 134 through the first oil through hole 126*a* and the second oil through hole 126*b* may be quickly introduced into a main-side second pocket 1313*b* and a sub-side second pocket 1323*b*.

The compression units 131, 132, 133, and 134 may further include cylinder 133 having a compression space 410 formed by the main bearing 131 and the sub bearing 132 installed on or at both sides in the axial direction, and rotor 134 disposed rotatably inside of the cylinder 133. Referring FIGS. 1 and 2, the main bearing 131 and the sub bearing 132 may be disposed in the casing 110. The main bearing 131 and the sub bearing 132 may be fixed to the casing 110. The main bearing 131 and the sub bearing 132 may be spaced apart from each other along the rotational shaft 123. The main bearing 131 and the sub bearing 132 may be spaced apart from each other in the axial direction. In this embodiment, the axial direction may refer to an up-down or vertical direction with respect to FIG. 1.

The main bearing 131 and the sub bearing 132 may support the rotational shaft 123 in a radial direction. The main bearing 131 and the sub bearing 132 may support the cylinder 133 and the rotor 134 in the axial direction. The main bearing 131 and the sub bearing 132 may include the first and second bearing portions 1311 and 1321 which support the rotational shaft 123 in the radial direction, and flange portions (flanges) 1312 and 1322 which extend in the radial direction from the bearing portions 1311 and 1321. More specifically, the main bearing 131 may include the first bearing portion 1311 that supports the rotational shaft 123 in the radial direction and the first flange portion 1312 that extends in the radial direction from the first bearing portion 1311, and the sub bearing 132 may include the second bearing portion 1321 that supports the rotational shaft 123 in the radial direction and the second flange portion 1322 that extends in the radial direction from the second bearing portion 1321.

Each of the first bearing portion 1311 and the second bearing portion 1321 may be formed in a bush shape. Each of the first flange portion 1312 and the second flange portion 1322 may be formed in a disk shape. The first oil groove 1311*b* may be formed on the main bearing surface 1311*a* which is a radially inner peripheral surface of the first bearing portion 1311. The second oil groove 1321*b* may be formed on the sub bearing surface 1321*a* which is a radially inner peripheral surface of the second bearing portion 1321. The first oil groove 1311*b* may be formed in a straight line or an oblique line between upper and lower ends of the first bearing portion 1311. The second oil groove 1321*b* may be formed in a straight line or an oblique line between upper and lower ends of the second bearing portion 1321.

A first communication channel 1315 may be formed in the first oil groove 1311*b*. A second communication channel 1325 may be formed in the second oil groove 1321*b*. The first communication channel 1315 and the second communication channel 1325 may guide oil flowing into the main bearing surface 1311*a* and the sub bearing surface 1321*a* to a main-side back pressure pocket 1313 and a sub-side back pressure pocket 1323.

The main-side back pressure pocket 1313 may be formed in the first flange portion 1312. The sub-side back pressure pocket 1323 may be formed in the second flange portion 1322. The main-side back pressure pocket 1313 may include a main-side first pocket 1313*a* and the main-side second pocket 1313*b*. The sub-side back pressure pocket 1323 may include a sub-side first pocket 1323*a* and the sub-side second pocket 1323*b*.

The main-side first pocket 1313*a* and the main-side second pocket 1313*b* may be formed at predetermined intervals along a circumferential direction. The sub-side first pocket 1323*a* and the sub-side second pocket 1323*b* may be formed at predetermined intervals along the circumferential direction.

The main-side first pocket 1313*a* may form a lower pressure than the main-side second pocket 1313*b*, for example, an intermediate pressure between a suction pressure and a discharge pressure. The sub-side first pocket 1323*a* may form a lower pressure than the sub-side second pocket 1323*b*, for example, the intermediate pressure between the suction pressure and the discharge pressure. The pressure of the main-side first pocket 1313*a* and the pressure of the sub-side first pocket 1323*a* may correspond to each other.

As oil passes through a fine passage between a main-side first bearing protrusion 1314*a* and an upper surface 134*a* of the rotor 134 and flows into the main-side first pocket 1313*a*, the pressure in the first main pocket 1313*a* may be reduced and form the intermediate pressure. As oil passes through a fine passage between a sub-side first bearing protrusion 1324*a* and a lower surface 134*b* of the rotor 134 and flows into the sub-side first pocket 1323*a*, the pressure of the sub-side first pocket 1323*a* may be reduced and form the intermediate pressure.

Oil flowing into the main bearing surface 1311*a* through the first oil through hole 126*a* may flow into the main-side second pocket 1313*b* through the first communication flow channel 1315, and thus, the pressure of the main-side second pocket 1313*b* may be maintained at the discharge pressure or similar to the discharge pressure. Oil flowing into the sub bearing surface 1321*a* through the second oil through hole 126*b* may flow into the sub-side second pocket 1323*b* through the second communication channel 1325, and thus, the pressure of the second sub-side pocket 1323*b* may be maintained at the discharge pressure or similar to the discharge pressure.

In the cylinder 133 of FIG. 1, an inner peripheral surface forms the compression space 410 in a circular shape. Alternatively, the inner peripheral surface of the cylinder 133 may be formed in a symmetrical ellipse shape having a pair of long and short axes, or an asymmetrical ellipse shape having several pairs of long and short axes. An outer peripheral surface of the cylinder 133 may be formed in a circular shape; however, embodiments are not limited thereto and may be variously changed as long as it can be fixed to the inner peripheral surface of the casing 110. The cylinder 133 may be fastened to the main bearing 131 or the sub bearing 132 fixed to the casing 110 with a bolt, for example.

An empty space portion (empty space) may be formed at a center of the cylinder 133 to form the compression space 410 including an inner peripheral surface. The empty space may be sealed by the main bearing 131 and the sub bearing 132 to form the compression space 410. The rotor 134 having an outer peripheral surface formed in a circular shape may be rotatably disposed in the compression space 410.

A suction port 1331 and a discharge port 1332 may be respectively formed on an inner peripheral surface 133*a* of the cylinder 133 on both sides in the circumferential direction about a contact point P at which the inner peripheral surface 133*a* of the cylinder 133 and an outer peripheral surface 134*c* of the rotor 134 are in close substantial contact with each other. The suction port 1331 and the discharge port 1332 may be spaced apart from each other. That is, the suction port 1331 may be formed on an upstream side based on a compression path (rotational direction), and the discharge port 1332 may be formed on a downstream side in a direction in which the refrigerant is compressed.

The suction port 1331 may be directly coupled to a suction pipe 113 that passes through the casing 110. The discharge port 1332 may be indirectly coupled with a discharge pipe 114 that communicates with the internal space S of the casing 110 and is coupled to pass through the casing 110. Accordingly, refrigerant may be directly suctioned into the compression space 410 through the suction port 1331, and the compressed refrigerant may be discharged to the internal space S of the casing 110 through the discharge port 1332 and then discharged to the discharge pipe 114. Therefore, the internal space S of the casing 110 may be maintained in a high-pressure state forming the discharge pressure.

More specifically, a high-pressure refrigerant discharged from the discharge port 1332 may stay in the internal space S adjacent to the compression units 131, 132, 133 and 134. As the main bearing 131 is fixed to the inner peripheral surface of the casing 110, upper and lower sides of the internal space S of the casing 110 may be bordered or enclosed. In this case, the high-pressure refrigerant staying in the internal space S may flow through a discharge channel 1316 and be discharged to the outside through the discharge pipe 114 provided on or at the upper side of the casing 110.

The discharge channel 1316 may penetrate the first flange portion 1312 of the main bearing 131 in the axial direction. The discharge channel 1316 may secure a sufficient channel area so that no channel resistance occurs. More specifically, the discharge channel 1316 may extend along the circumferential direction in a region which does not overlap with the cylinder 133 in the axial direction. That is, the discharge channel 1316 may be formed in an arc shape.

In addition, the discharge channel 1316 may include a plurality of holes spaced apart in the circumferential direction. As described above, as the maximum channel area is secured, channel resistance may be reduced when the high-pressure refrigerant moves to the discharge pipe 114 provided on the upper side of the casing 110.

Further, while a separate suction valve is not installed in the suction port 1331, a discharge valve 1335 to open and close the discharge port 1332 may be disposed in the discharge port 1332. The discharge valve 1335 may include a reed valve having one (first) end fixed and the other (second) end forming a free end. Alternatively, the discharge valve 1335 may be variously changed as needed, and may be, for example, a piston valve.

When the discharge valve 1335 is a reed valve, a discharge groove (not illustrated) may be formed on the outer peripheral surface of the cylinder 133 so that the discharge valve 1335 may be mounted therein. Accordingly, a length of the discharge port 1332 may be reduced to a minimum, and thus, dead volume may be reduced. At least portion of the valve groove may be formed in a triangular shape to secure a flat valve seat surface, as illustrated in FIG. 2.

In this embodiment, one discharge port 1332 is provided as an example; however, embodiments are not limited thereto, and a plurality of discharge ports 1332 may be provided along a compression path (compression progress direction).

The rotor 134 may be disposed on the cylinder 133. The rotor 134 may be disposed inside of the cylinder 133. The rotor 134 may be disposed in the compression space 410 of the cylinder 133. The outer peripheral surface 134*c* of the rotor 134 may be formed in a circular shape. The rotational shaft 123 may be disposed at the center of the rotor 134. The rotational shaft 123 may be integrally coupled to the center of the rotor 134. Accordingly, the rotor 134 has a center $O_r$ which matches an axial center $O_s$ of the rotational shaft 123, and may rotate concentrically together with the rotational shaft 123 around the center $O_r$ of the rotor 134.

The center $O_r$ of the rotor 134 may be eccentric with respect to a center $O_c$ of the cylinder 133, that is, the center $O_c$ of the internal space of the cylinder 133. One side of the outer peripheral surface 134*c* of the rotor 134 may almost come into contact with the inner peripheral surface 133*a* of the cylinder 133. The outer peripheral surface 134*c* of the rotor 134 does not actually come into contact with the inner peripheral surface 133*a* of the cylinder 133. That is, the outer peripheral surface 134*c* of the rotor 134 and the inner peripheral surface of the cylinder 133 are spaced apart from each other so that frictional damage does not occur, but should be close to each other so as to limit leakage of high-pressure refrigerant in a discharge pressure region to a suction pressure region through between the outer peripheral surface 134*c* of the rotor 134 and the inner peripheral surface 133*a* of the cylinder 133. A point at which one side of the rotor 134 is almost in contact with the cylinder 133 may be regarded as the contact point P.

The rotor 134 may have at least one vane slot 1341*a*, 1341*b*, and 1341*c* formed at an appropriate location of the outer peripheral surface 134*c* along the circumferential direction. The vane slots 1341*a*, 1341*b*, and 1341*c* may include first vane slot 1341*a*, second vane slot 1341*b*, and third vane slot 1341*c*. In this embodiment, three vane slots 1341*a*, 1341*b*, and 1341*c* are described as an example. However, embodiments are not limited thereto and the vane slot may be variously changed according to a number of vanes 1351, 1352, and 1353.

Each of the first to third vanes 1351, 1352, and 1353 may be slidably coupled to each of the first to third vane slots 1341*a*, 1341*b*, and 1341*c*. Each of the first to third vane slots 1341*a*, 1341*b*, and 1341*c* may extend in a radial direction. An extending straight line of each of the first to third vane slots 1341*a*, 1341*b*, and 1341*c* may not pass through the center $O_r$ of the rotor 134, respectively. In this embodiment, an example is described in which the extending straight line of each of the first to third vane slots 1341*a*, 1341*b*, and 1341*c* does not pass through the center $O_r$ of the rotor 134. However, embodiments are not limited thereto, and the extending straight line of each of the first to third vane slots 1341*a*, 1341*b*, and 1341*c* may pass through the center $O_r$ of the rotor 134.

First to third back pressure chambers 342*a*, 1342*b*, and 1342*c* may be respectively formed on inner ends of the first to third vane slots 1341*a*, 1341*b*, and 1341*c*, so that the first to third vanes 1351, 1352, and 1353 allows oil or refrigerant to flow into a rear side and the first to third vanes 1351, 1352, and 1353 may be biased in a direction of the inner peripheral surface of the cylinder 133. The first to third back pressure chambers 1342*a*, 1342*b*, and 1342*c* may be sealed by the main bearing 131 and the sub bearing 132. The first to third back pressure chambers 1342*a*, 1342*b*, and 1342*c* may each independently communicate with the back pressure pockets 1313 and 1323. Alternatively, the first to third back pressure chambers 1342*a*, 1342*b*, and 1342*c* may communicate with each other by the back pressure pockets 1313 and 1323.

The back pressure pockets 1313 and 1323 may be formed on the main bearing 131 and the sub bearing 132, respectively, as illustrated in FIG. 1. Alternatively, the back pressure pockets 1313 and 1323 may be formed only on any one of the main bearing 131 or the sub bearing 132. In this embodiment, the back pressure pockets 1313 and 1323 are formed in both the main bearing 131 and the sub bearing 132 as an example. The back pressure pockets 1313 and 1323 may include the main-side back pressure pocket 1313 formed in the main bearing 131 and the sub-side back pressure pocket 1323 formed in the sub bearing 132.

The main-side back pressure pocket 1313 may include the main-side first pocket 1313*a* and the main-side second pocket 1313*b*. The main-side second pocket 1313*b* may generate a higher pressure than the main-side first pocket 1313*a*. The sub-side back pressure pocket 1323 may include the sub-side first pocket 1323*a* and the sub-side second pocket 1323*b*. The sub-side second pocket 1323*b* may generate a higher pressure than the sub-side first pocket 1323*a*. Accordingly, the main-side first pocket 1313*a* and the sub-side first pocket 1323*a* may communicate with a vane chamber to which a vane located at a relatively upstream side (from the suction stroke to the discharge stroke) among the vanes 1351, 1352, and 1353 belongs, and the main-side second pocket 1313*b* and the sub-side second pocket 1323*b* may communicate with a vane chamber to which a vane located at a relatively downstream side (from the discharge stroke to the suction stroke) among the vanes 1351, 1352, and 1353 belongs.

In the first to third vanes 1351, 1352, and 1353, the vane closest to the contact point P based on a compression progress direction may be referred to as the second vane 1352, and the following vanes may be referred to as the first vane 1351 and the third vane 1353. In this case, the first vane 1351 and the second vane 1352, the second vane 1352 and the third vane 1353, and the third vane 1353 and the first vane 1351 may be spaced apart from each other by a same circumferential angle.

When a compression chamber formed by the first vane 1351 and the second vane 1352 is referred to as a "first compression chamber V1", a compression chamber formed by the first vane 1351 and the third vane 1353 is referred to as a "second compression chamber V2", and the compression chamber formed by the third vane 1353 and the second vane 1352 is referred to as a "third compression chamber V3", all of the compression chambers V1, V2, and V3 have a same volume at a same crank angle. The first compression chamber V1 may be referred to as a "suction chamber", and the third compression chamber V3 may be referred to as a "discharge chamber".

Each of the first to third vanes 1351, 1352, and 1353 may be formed in a substantially rectangular parallelepiped shape. Referring to ends of each of the first to third vanes

1351, 1352, and 1353 in the longitudinal direction, a surface in contact with or facing the inner peripheral surface 133*a* of the cylinder 133 may be referred to as a "distal end surface", and a surface facing each of the first to third back pressure chambers 1342*a*, 1342*b*, and 1342*c* may be referred to as a "rear end surface". The distal end surface of each of the first to third vanes 1351, 1352, and 1353 may be formed in a curved shape so as to come into line contact with the inner peripheral surface 133*a* of the cylinder 133. The rear end surface of each of the first to third vanes 1351, 1352, and 1353 may be formed to be flat to be inserted into each of the first to third back pressure chambers 1342*a*, 1342*b*, and 1342*c* and to receive the back pressure evenly.

In the rotary compressor 100, when power is applied to the drive motor 120 and the rotor 122 and the rotational shaft 123 rotate, the rotor 134 rotates together with the rotational shaft 123. In this case, each of the first to third vanes 1351, 1352, 1353 may be withdrawn from each of the first to third vane slots 1341*a*, 1341*b*, and 1341*c*, due to centrifugal force generated by rotation of the rotor 134 and a back pressure of each of the first to third back pressure chambers 1342*a*, 1342*b*, and 1342*c* disposed at a rear side of each of the first to third back pressure chambers 1342*a*, 1342*b*, and 1342*c*. Accordingly, the distal end surface of each of the first to third vanes 1351, 1352, and 1353 comes into contact with the inner peripheral surface 133*a* of the cylinder 133.

In this embodiment, the distal end surface of each of the first to third vanes 1351, 1352, and 1353 is in contact with the inner peripheral surface 133*a* of the cylinder 133 may mean that the distal end surface of each of the first to third vanes 1351, 1352, and 1353 comes into direct contact with the inner peripheral surface 133*a* of the cylinder 133, or the distal end surface of each of the first to third vanes 1351, 1352, and 1353 is adjacent enough to come into direct contact with the inner peripheral surface 133*a* of the cylinder 133.

The compression space 410 of the cylinder 133 forms a compression chamber (including suction chamber or discharge chamber) (V1, V2, V3) by the first to third vanes 1351, 1352, and 1353, and a volume of each of the compression chambers V1, V2, V3 may be changed by eccentricity of the rotor 134 while moving according to rotation of the rotor 134. Accordingly, while the refrigerant filling each of the compression chambers V1, V2, and V3 moves along the rotor 134 and the vanes 1351, 1352, and 1353, the refrigerant is suctioned, compressed, and discharged.

The first to third vanes 1351, 1352, 1353 may include upper pins 1351*a*, 1352*a*, 1353*a* and lower pins 1351*b*, 1352*b*, and 1353*b*, respectively. The upper pins 1351*a*, 1352*a*, and 1353*a* may include first upper pin 1351*a* formed on an upper surface of the first vane 1351, second upper pin 1352*a* formed on an upper surface of the second vane 1352, and third upper pin 1353*a* formed on an upper surface of the third vane 1353. The lower pins 1351*b*, 1352*b*, and 1353*b* may include first lower pin 1351*b* formed on a lower surface of the first vane 1351, second lower pin 1352*b* formed on a lower surface of the second vane 1352, and third lower pin 1353*b* formed on a lower surface of the third vane 1353.

The lower surface of the main bearing 131 may include a first rail groove 1317 into which the upper pins 1351*a*, 1352*a*, and 1353*a* may be inserted. The first rail groove 1317 may be formed in a circular band shape. The first rail groove 1317 may be disposed adjacent to the rotational shaft 123. The first to third upper pins 1351*a*, 1352*a*, and 1353*a* of the first to third vanes 1351, 1352, and 1353 may be inserted into the first rail groove 1317 so that positions of the first to third vanes 1351, 1352, and 1353 may be guided. Accordingly, it is possible to prevent direct contact between the vane 1351, 1352, and 1353 and the cylinder 133, improve compression efficiency, and prevent decrease in reliability caused by wear of components.

The lower surface of the main bearing 131 may include a first stepped portion 1318 disposed adjacent to the first rail groove 1317. The first stepped portion 1318 may be disposed between the lower surface of the main bearing 131 and the first rail groove 1317. An outermost side of the first stepped portion 1318 may be disposed inside an outer surface of the rotor 134. An innermost side of the first stepped portion 1318 may be disposed outside of the rotational shaft 123. Accordingly, the first stepped portion 1318 increases an area of the compression space 410 to decrease the pressure of the compression space 410, and thus, a load applied to the first to third upper pins 1351*a*, 1352*a*, 1353*a* may be reduced, and damage to components may be prevented.

In addition, the first stepped portion 1318 may be disposed adjacent to the suction port 1331. A width of the first stepped portion 1318 may increase as it extends closer to the suction port 1331. More specifically, referring to FIGS. 3, 4, 6, and 7, a cross section of the first stepped portion 1318 may be formed in a half-moon shape, the first stepped portion 1318 may be disposed closer to the suction port 1331 than the discharge port 1332, and the width of the first stepped portion 1318 may increase as it extends closer to the suction port 1331. Accordingly, it is possible to improve efficiency by reducing the load applied to the first to third upper pins 1351*a*, 1352*a*, and 1353*a*.

The upper surface of the sub bearing 132 may include a second rail groove 1327 into which the lower pins 1351*b*, 1352*b*, and 1353*b* may be inserted. The second rail groove 1327 may be formed in a circular band shape. The second rail groove 1327 may be disposed adjacent to the rotational shaft 123. The first to third lower pins 1351*b*, 1352*b*, 1353*b* of the first to third vanes 1351, 1352, 1353 may be inserted into the second rail groove 1327 so that positions of the first to third vanes 1351, 1352, and 1353 may be guided. Accordingly, it is possible to prevent direct contact between the vane 1351, 1352, 1353 and the cylinder 133, improve compression efficiency, and prevent a decrease in reliability caused by wear of components.

The first rail groove 1317 and the second rail groove 1328 may be formed in a shape corresponding to each other. The first rail groove 1317 and the second rail groove 1328 may overlap each other in the axial direction. Accordingly, efficiency of guiding positions of the first to third vanes 1351, 1352, and 1353 may be improved.

The sub bearing 132 may include a second stepped portion 1328 disposed adjacent to the second rail groove 1327. The second stepped portion 1328 may be disposed between the upper surface of the sub bearing 132 and the second rail groove 1327. An outermost side of the second stepped portion 1328 may be disposed inside of the outer surface of the rotor 134. An innermost side of the second stepped portion 1328 may be disposed outside of the rotational shaft 123. Accordingly, the second stepped portion 1328 increases an area of the compression space 410 to decrease pressure of the compression space 410, and thus, the load applied to the first to third lower pins 1351*b*, 1352*b*, and 1353*b* may be reduced, and damage to components may be prevented.

In addition, the second stepped portion 1328 may be disposed adjacent to the suction port 1331. A width of the second stepped portion 1328 may increase as it extends closer to the suction port 1331. More specifically, referring to FIGS. 3, 4, 6, and 7, a cross section of the second stepped portion 1328 may be formed in a half-moon shape, the second stepped portion 1328 may be disposed closer to the suction port 1331 than the discharge port 1332, and the width of the second stepped portion 1328 may increase as it extends closer to the suction port 1331. Accordingly, it is possible to improve efficiency of reducing load applied to the first to third lower pins 1351*b*, 1352*b*, and 1353*b*.

The first stepped portion 1318 and the second stepped portion 1328 may be formed in a shape corresponding to each other. The first stepped portion 1318 and the second stepped portion 1328 may overlap each other in the axial direction. Accordingly, it is possible to improve efficiency of reducing load applied to the first to third lower pins 1351*b*, 1352*b*, and 1353*b*.

In this embodiment, it is described as an example that there are three vanes 1351, 1352, and 1353, three vane slots 1341*a*, 1341*b*, and 1341*c*, and three back pressure chambers 1342*a*, 1342*b*, and 1342*c*. However, the number of the vanes 1351, 1352, and 1353, the number of vane slots 1341*a*, 1341*b*, and 1341*c*, and the number of back pressure chambers 1342*a*, 1342*b*, and 1342*c* may be variously changed.

In addition, in this embodiment, it is described as an example that the vanes 1351, 1352, and 1353 include both the upper pins 1351*a*, 1352*a*, and 1353*a* and the lower pins 1351*b*, 1352*b*, and 1353*b*. However, only the upper pins 1351*a*, 1352*a*, and 1353*a* may be formed, or only the lower fins 1351*b*, 1352*b*, and 1353*b* may be formed.

Referring to FIG. 2, a radius of curvature of the distal end surface of each of the vanes 1351, 1352, and 1353 facing the inner peripheral surface 133*a* of the cylinder 133 may be smaller than an inner diameter of the cylinder 133 in an angle (angle range) from 40° (b) to 160° (c) in a rotational direction based on a suction completion point w. In this embodiment, the suction completion point w refers to a point at which an area of the first compression chamber V1 becomes largest. When the number of vanes 1351, 1352, and 1353 is 3, the radius of curvature of the distal end surface of vanes 1351, 1352, and 1353 may be smaller than an inner diameter of the cylinder 133 at an angle of 120° in the rotational direction based on the suction completion point w. When the radius of curvature of the distal end surface of vanes 1351, 1352, and 1353 is larger than the inner diameter of the cylinder 133 at an angle between 40° (b) and 160° (c) in the rotational direction based on the suction completion point w, refrigerant may leak into a space between the distal end surface of each of the vanes 1351, 1352, and 1353 and the inner peripheral surface 133*a* of the cylinder 133 during a compression stroke. Accordingly, it is possible to prevent the refrigerant from leaking into the space between the distal end surface of each of the vanes 1351, 1352, and 1353 and the inner peripheral surface 133*a* of the cylinder 133, and thus, improve compression efficiency. In this embodiment, the number of vanes 1351, 1352, and 1353 is 3 as an example; however, the number of vanes 1351, 1352, and 1353 may be changed from two to five, for example.

The distal end surface of each of the vanes 1351, 1352, and 1353 may be concentric with the inner peripheral surface of the cylinder 133 at the angle between 40° (b) and 160° (c) in the rotational direction based on the suction completion point w. When the distal end surface of each of the vanes 1351, 1352, and 1353 is not concentric with the inner peripheral surface 133*a* of the cylinder 133 at the angle between 40° (b) and 160° (c) in the rotational direction based on the suction completion point w, refrigerant may leak into the space between the distal end surface of each of the vanes 1351, 1352, and 1353 and the inner peripheral surface 133*a* of the cylinder 133. Accordingly, it is possible to prevent refrigerant from leaking into the space between the distal end surface of each of the vanes 1351, 1352, and 1353 and the inner peripheral surface 133*a* of the cylinder 133 and, thus, improve compression efficiency.

An angle a between a longitudinal virtual line L1 of each of the vanes 1351, 1352, and 1353 and a straight line L2 that passes through a center of the distal end surface of each of the vanes 1351, 1352, and 1353 and the center Or of the rotor 134 may be between 5° and 20°. In this case, at least one of the rail grooves 1317 and 1327 or the inner peripheral surface 133*a* of the cylinder 133 may be formed in a circular shape. More specifically, at least one of the rail grooves 1317 and 1327 or the inner peripheral surface 133*a* of the cylinder 133 may be formed in a true circular shape rather than an ellipse. When the angle a between the longitudinal virtual line L1 of each of the vanes 1351, 1352, and 1353 and the straight line L2 that passes through the center of the distal end surface of each of the vanes 1351, 1352, and 1353 and the center Or of the rotor 134 is less than 5° or more than 20°, refrigerant may leak into the space between the distal end surface of each of the vanes 1351, 1352, and 1353 and the inner peripheral surface 133*a* of the cylinder 133. Accordingly, it is possible prevent refrigerant from leaking into the space between the distal end surface of each of the vanes 1351, 1352, and 1353 and the inner peripheral surface 133*a* of the cylinder 133, and thus, improve compression efficiency.

The distal end surfaces of each of the vanes 1351, 1352, and 1353 may include a chamfer 1351*c* formed at an edge. Referring to FIGS. 2 and 9, the chamfer 1351*c* may be formed on an edge in a direction opposite to the rotational direction of the edges of the distal end surface of each of the vanes 1351, 1352, and 1353. In this case, a length l of the chamfer 1351*c* in a direction perpendicular to a longitudinal virtual line L1 of each of the vanes 1351, 1352, and 1353 may be equal to or less than half a width of each of the vanes 1351, 1352, and 1353. When the length l of the chamfer 1351*c* in the direction perpendicular to the longitudinal virtual line L1 of each of the vanes 1351, 1352, and 1353 is equal to or more than half the width of each of the vanes 1351, 1352, and 1353, the distal end surface of each of the vanes 1351, 1352, and 1353 and the inner peripheral surface 133*a* of the cylinder 133 may collide with each other. Accordingly, it is possible to prevent collision between the distal end surface of each of the vanes 1351, 1352, and 1353 and the inner peripheral surface 133*a* of the cylinder 133 during the compression process, prevent damage to a product, and extend a life of the product.

An angle between the chamfer 1351*c* and the longitudinal virtual line L1 of each of the vanes 1351, 1352, and 1353 may be between 70° and 90°. When the angle between the chamfer 1351*c* and the longitudinal virtual line L1 of each of the vanes 1351, 1352, and 1353 is less than 70°, refrigerant may leak into the space between the distal end surface of each of the vanes 1351, 1352, and 1353 and the inner peripheral surface 133*a* of the cylinder 133. Moreover, when the angle between the chamfer 1351*c* and the longitudinal virtual line L1 of each of the vanes 1351, 1352, and 1353 is more than 90°, the distal end surface of each of the vanes 1351, 1352, and 1353 and the inner peripheral surface 133*a* of the cylinder 133 may collide with each other. Accordingly, it is possible to prevent refrigerant from leaking into the space between the distal end surface of each of the vanes 1351, 1352, and 1353 and the inner peripheral surface 133*a* of the cylinder 133 to improve compression efficiency, prevent collision between the distal end surface of each of the vanes 1351, 1352, and 1353 and the inner peripheral surface 133*a* of the cylinder 133 during the compression process to prevent damage to a product, and extend the life of the product.

A process in which refrigerant is suctioned from the cylinder 133, compressed, and discharged according to an embodiment will be described with reference to FIGS. 8 to 10.

Referring to FIG. 8, the volume of the first compression chamber V1 is continuously increases until the first vane 1351 passes through the suction port 1331 and the second vane 1352 reaches a completion point of suction w. In this case, the refrigerant may continuously flow into the first compression chamber V1 from the suction port 1331.

The first back pressure chamber 1342*a* disposed on a rear side of the first vane 1351 may be exposed to the main-side first pocket 1313*a* of the main-side back pressure pocket 1313 and the main-side second pocket 1313*b* of the main-side back pressure pocket 1313 disposed on a rear side of the second vane 1352. Accordingly, the intermediate pressure may be formed in the first back pressure chamber 1342*a*, and thus, the first vane 1351 pressurized at an intermediate pressure so as to be in close contact with the inner peripheral surface 133*a* of the cylinder 133. Moreover, the discharge pressure or the pressure close to the discharge pressure may be formed in the second back pressure chamber 1342*b* so as to be in close contact with the inner peripheral surface 133*a* of the cylinder.

Referring to FIG. 9, when the second vane 1352 passes the completion point of suction or the start point of compression w and proceeds to the compression stroke, the first compression chamber V1 is sealed and may move in the direction of the discharge port 1332 together with the rotor 134. In this process, the volume of the first compression chamber V1 continuously decreases, and the refrigerant of the first compression chamber V1 may be gradually compressed. In this embodiment, the suction completion point w refers to the point at which the area of the first compression chamber V1 becomes the largest.

Referring to FIG. 10, when the first vane 1351 passes through the discharge port 1332 and the second vane 1352 does not reach the discharge port 1332, the discharge valve 1335 may be opened by the pressure of the first compression chamber V1 while the first compression chamber V1 communicates with the discharge port 1332. In this case, the refrigerant of the first compression chamber V1 may be discharged to the internal space of the casing 110 through the discharge port 1332.

At this time, the first back pressure chamber 1342*a* of the first vane 1351 passes through the main-side second pocket 1313*b*, which is a discharge pressure region, and may be just before entering the main-side first pocket 1313*a*, which is an intermediate pressure region. Accordingly, the back pressure formed in the first back pressure chamber 1342*a* of the first vane 1351 may decrease from the discharge pressure to an intermediate pressure.

The second back pressure chamber 1342*b* of the second vane 1352 may be located in the main-side second pocket 1313*b*, which is a discharge pressure region, and a back pressure corresponding to the discharge pressure may be formed in the second back pressure chamber 1342*b*.

Accordingly, the intermediate pressure between the suction pressure and the discharge pressure may be formed at the rear end of the first vane 1351 located in the main-side first pocket 1313*a*, and the discharge pressure (actually, a pressure slightly lower than the discharge pressure) may be formed at the rear end of the second vane 1352 located in the main-side second pocket 1313*b*. In particular, the main-side second pocket 1313*b* may communicate directly with the oil flow path 125 through the first oil through hole 126*a* and the first communication channel 1315, and thus, it is possible to prevent the pressure in the second back pressure chamber 1342*b* communicating with the main-side second pocket 1313*b* from increasing above the discharge pressure. Accordingly, the intermediate pressure lower than the discharge pressure may be formed in the main-side first pocket 1313*a*, and thus, mechanical efficiency between the cylinder 133 and the vanes 1351, 1352, and 1353 may increase. In addition, the discharge pressure or the pressure slightly lower than the discharge pressure may be formed in the main second pocket 1313*b*, and thus, the vanes 1351, 1352, and 1353 may be disposed adjacent to the cylinder 133 to increase mechanical efficiency while suppressing leakage between the compression chambers and it may increase efficiency.

Referring to FIG. 11, in the rotary compressor 100 according to this embodiment, it can be seen that the load applied to the upper pins 1351*a*, 1352*a*, and 1353*a* and/or the lower pins 1351*b*, 1352*b*, 1353*b* of the vanes 1351, 1352, and 1353) decreases. In FIG. 11, the upper graph indicates pressure applied to upper pins and/or lower pins of vanes in an existing (related art) rotary compressor, and the lower graph indicates pressure applied to upper pins 1351*a*, 1352*a*, and 1353*a* and/or lower pins 1351*b*, 1352*b*, and 1353*b* of vanes 1351, 1352, and 1353 in rotary compressor 100 according to embodiments. That is, in embodiments, the load applied to the upper pins 1351*a*, 1352*a*, and 1353*a* and/or the lower pins 1351*b*, 1352*b*, and 1353*b* may be reduced, and thus, damage to the components may be prevented.

Certain or other embodiments described are not mutually exclusive or distinct. In certain embodiments or other embodiments described above, their respective configurations or functions may be used together or combined with each other.

For example, it means that a configuration A described in a specific embodiment and/or a drawing may be coupled to a configuration B described in another embodiment and/or a drawing. That is, even if a combination between components is not directly described, it means that the combination is possible except for a case where it is described that the combination is impossible.

The above description should not be construed as restrictive in all respects and should be considered as illustrative. A scope should be determined by rational interpretation of the appended claims, and all changes within the equivalent scope are included in the scope.

According to embodiments disclosed herein, it is possible to provide a rotary compressor capable of preventing contact between a vane and a cylinder to improve compression efficiency. Further, it is possible to provide a rotary compressor capable of preventing contact between a vane and a cylinder to prevent a decrease in reliability caused by wear. Furthermore, it is possible to provide a rotary compressor capable of preventing refrigerant from leaking into a space between a distal end surface of a vane and an inner peripheral surface of a cylinder to improve compression efficiency. Moreover, it is possible to provide a rotary compressor capable of reducing a load applied to a pin of a vane to prevent damage to a product.

Embodiments disclosed herein provide a rotary compressor capable of preventing contact between a vane and a cylinder to improve compression efficiency. Embodiments disclosed herein further provide a rotary compressor capable of preventing a contact between a vane and a cylinder to prevent a decrease in reliability caused by wear. Embodiments disclosed herein furthermore provide a rotary compressor capable of preventing refrigerant from leaking into a space between a distal end surface of a vane and an inner peripheral surface of a cylinder to improve compression efficiency. Additionally, embodiments disclosed herein provide a rotary compressor capable of reducing a load applied to a pin of a vane to prevent damage to a product.

Embodiments disclosed herein provide a rotary compressor that may include a rotational shaft; first and second bearings configured to support the rotational shaft in a radial direction; a cylinder disposed between the first and second bearings to form a compression space; a rotor disposed in the compression space and coupled to the rotational shaft to compress a refrigerant as the rotor rotates; and at least one vane slidably inserted into the rotor, each vane coming into contact with an inner peripheral surface of the cylinder to separate the compression space into a plurality of regions. The at least one vane may include a pin that extends in an axial direction. At least one of the first bearing or the second bearing may include a rail groove into which the pin may be inserted. Accordingly, it is possible to prevent contact between the vane and the cylinder to improve compression efficiency. Moreover, it is possible to prevent contact between the vane and the cylinder to prevent a decrease in reliability caused by wear.

A radius of curvature of a distal end surface of the at least one vane facing the inner peripheral surface of the cylinder may be smaller than an inner diameter of the cylinder in an angle range from 40° to 160° in a rotational direction based on a suction completion point. Accordingly, it is possible to prevent refrigerant from leaking into a space between a distal end surface of the vane and the inner peripheral surface of the cylinder to improve compression efficiency. Moreover, it is possible to reduce a load applied to a pin of a vane to prevent damage to a product.

The distal end surface of the at least one vane may be coaxial with the inner peripheral surface of the cylinder in the angle range from 40° to 160° in the rotational direction based on the suction completion point. An angle between a longitudinal virtual line of the at least one vane and a straight line that passes through a center of the distal end surface of the at least one vane and a center of the rotor may be 5° to 20°.

The distal end surface of the at least one vane may include a chamfer formed on an edge. The chamfer may be formed on an edge in a direction opposite to the rotational direction of edges of the distal end surface of the at least one vane.

A length of the chamfer in a direction perpendicular to the virtual line may be equal to or less than half of a width of the at least one vane. An angle between the chamfer and the virtual line may be 70° to 90°.

At least one of the rail groove or the inner peripheral surface of the cylinder may be formed in a circular shape.

Embodiments disclosed herein further provide a rotary compressor that may include a rotational shaft; first and second bearings configured to support the rotational shaft in a radial direction; a cylinder disposed between the first and second bearings to form a compression space; a rotor disposed in the compression space and coupled to the rotational shaft to compress a refrigerant as the rotor rotates; and at least one vane slidably inserted into the rotor, each vane coming into contact with an inner peripheral surface of the cylinder to separate the compression space into a plurality of regions. The at least one vane may include a pin that extends in an axial direction, and at least one of the first bearing or the second bearing may include a rail groove into which the pin may be inserted. Accordingly, it is possible to prevent contact between the vane and the cylinder to improve compression efficiency. Moreover, it is possible to prevent contact between the vane and the cylinder to prevent a decrease in reliability caused by wear.

A distal end surface of the at least one vane facing the inner peripheral surface of the cylinder may be coaxial with the inner peripheral surface of the cylinder in an angle range from 40° to 160° in a rotational direction based on a suction completion point. Accordingly, it is possible to prevent refrigerant from leaking into the space between the distal end surface of the vane and the inner peripheral surface of the cylinder to improve compression efficiency. Moreover, it is possible to reduce the load applied to the pin of the vane to prevent damage to a product.

A radius of curvature of the distal end surface of the at least one vane may be smaller than an inner diameter of the cylinder in the angle range from 40° to 160° in the rotational direction based on the suction completion point. An angle between a longitudinal virtual line of the at least one vane and a straight line that passes through a center of the distal end surface of the at least one vane and a center of the rotor may be 5° to 20°.

The distal end surface of the at least one vane may include a chamfer formed on an edge. A length of the chamfer in a direction perpendicular to the virtual line may be equal to or less than half of a width of the at least one vane. An angle between the chamfer and the virtual line may be 70° to 90°.

Embodiments disclosed herein furthermore provide a rotary compressor that may include a rotational shaft; first and second bearings configured to support the rotational shaft in a radial direction; a cylinder disposed between the first and second bearings to form a compression space; a rotor disposed in the compression space and coupled to the rotational shaft to compress a refrigerant as the rotor rotates; and at least one vane slidably inserted into the rotor, each vane coming into contact with an inner peripheral surface of the cylinder to separate the compression space into a plurality of regions. The at least one vane may include a pin that extends in an axial direction, and at least one of the first bearing and the second bearing may include a rail groove into which the pin may be inserted. Accordingly, it is possible to prevent contact between the vane and the cylinder to improve compression efficiency. Moreover, it is possible to prevent contact between the vane and the cylinder to prevent a decrease in reliability caused by wear.

An angle between a longitudinal virtual line of the at least one vane and a straight line that passes through a center of the distal end surface of the at least one vane and a center of the rotor may be 5° to 20°. Accordingly, it is possible to prevent refrigerant from leaking into the space between the distal end surface of the vane and the inner peripheral surface of the cylinder to improve compression efficiency. Moreover, it is possible to reduce the load applied to the pin of the vane to prevent damage to a product.

The distal end surface of the at least one vane facing the inner peripheral surface of the cylinder may be coaxial with the inner peripheral surface of the cylinder in an angle range from 40° to 160° in a rotational direction based on a suction completion point. A radius of curvature of the distal end surface of the at least one vane facing the inner peripheral surface of the cylinder may be smaller than an inner diameter of the cylinder in an angle range from 40° to 160° in a rotational direction based on a suction completion point.

The distal end surface of the at least one vane facing the inner peripheral surface of the cylinder may include a chamfer formed on an edge. A length of the chamfer in a direction perpendicular to the virtual line may be equal to or less than half of a width of the at least one vane. An angle between the chamfer and the virtual line may be 70° to 90°.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a rotational shaft;

first and second bearings configured to support the rotational shaft in a radial direction;

a cylinder disposed between the first and second bearings to form a compression space;

a rotor disposed in the compression space and coupled to the rotational shaft to compress a refrigerant as the rotor rotates; and at least one vane slidably inserted into the rotor, the at least one vane coming into contact with an inner peripheral surface of the cylinder to separate the compression space into a plurality of regions, wherein the at least one vane comprises a pin that extends in an axial direction, wherein at least one of the first bearing or the second bearing comprises a rail groove into which the pin is inserted, wherein a distal end surface of the at least one vane comprises a chamfer formed on an edge, the chamfer being a cut-away straight sloping surface, and wherein an angle between the chamfer and a longitudinal virtual line of the at least one vane is 70° to 90°.

2. The rotary compressor of claim 1, wherein the distal end surface of the at least one vane is coaxial with the inner peripheral surface of the cylinder in an angle range from 40° to 160° in a rotational direction based on a suction completion point.

3. The rotary compressor of claim 1, wherein an angle between the longitudinal virtual line of the at least one vane and a straight line that passes through a center of the distal end surface of the at least one vane and a center of the rotor is 5° to 20°.

4. The rotary compressor of claim 1, wherein a radius of curvature of the distal end surface of the at least one vane facing the inner peripheral surface of the cylinder is smaller than an inner diameter of the cylinder in an angle range from 40° to 160° in a rotational direction based on a suction completion point.

5. The rotary compressor of claim 1, wherein the edge on which the chamfer is formed is an edge in a direction opposite to the rotational direction of edges of the distal end surface of the at least one vane.

6. The rotary compressor of claim 1, wherein a length of the chamfer in a direction perpendicular to the longitudinal virtual line is equal to or less than half of a width of the at least one vane.

7. The rotary compressor of claim 1, wherein at least one of the rail groove or the inner peripheral surface of the cylinder is formed in a circular shape.

* * * * *